US006343717B1

(12) United States Patent
Zhang et al.

(10) Patent No.: US 6,343,717 B1
(45) Date of Patent: Feb. 5, 2002

(54) PRE-FILLED DISPOSABLE PIPETTES

(76) Inventors: Jack Yongfeng Zhang; Frank Zhishi Xia; Mary Ziping Luo, all of 1886 Santa Anita Ave., So. El Monte, CA (US) 91733

( * ) Notice: Subject to any disclaimer, the term of this patent is extended or adjusted under 35 U.S.C. 154(b) by 0 days.

(21) Appl. No.: 09/713,551

(22) Filed: Nov. 21, 2000

(51) Int. Cl.[7] ..... B65D 37/00

(52) U.S. Cl. ..... 222/209; 222/562; 222/563; 222/541.6; 222/478; 222/54; 73/864.01; 422/100

(58) Field of Search ..... 222/209, 562, 222/563, 541.9, 541.6, 541.5, 478, 54; 422/100; 73/864.01

(56) References Cited

U.S. PATENT DOCUMENTS

| | | | | | |
|---|---|---|---|---|---|
| 898,456 | A | * | 9/1908 | Farnham | 73/864.01 |
| 2,423,173 | A | * | 7/1947 | Brady et al. | 222/189 |
| 2,994,349 | A | * | 8/1961 | Demos | 141/21 |
| 3,039,500 | A | * | 6/1962 | Goldberg | 141/26 |
| 3,141,336 | A | * | 7/1964 | Oates | 73/425.4 |
| 3,324,855 | A | * | 6/1967 | Heimlich | 128/269 |
| 3,518,804 | A | * | 7/1970 | Gerarde | 53/37 |
| 3,741,732 | A | * | 6/1973 | Stanfield | 73/425.4 |
| 3,748,909 | A | * | 7/1973 | Kuo | 73/425.4 |
| 3,938,392 | A | * | 2/1976 | Rodrigues | 73/425.6 |
| 3,951,313 | A | * | 4/1976 | Coniglione | 222/186 |
| 4,483,825 | A | * | 11/1984 | Fatches | 422/100 |
| 4,563,104 | A | * | 1/1986 | Saint-Amand | 401/139 |
| 4,779,768 | A | * | 10/1988 | St. Amand | 222/209 |
| 4,875,602 | A | * | 10/1989 | Chickering et al. | 222/187 |
| 5,048,727 | A | * | 9/1991 | Vlasich | 222/209 |
| 5,073,347 | A | * | 12/1991 | Garren et al. | 422/100 |
| 5,460,782 | A | * | 10/1995 | Coleman et al. | 422/100 |
| 5,702,035 | A | * | 12/1997 | Tsao | 222/187 |
| 5,927,884 | A | * | 7/1999 | Kao | 401/132 |
| 6,117,394 | A | * | 9/2000 | Smith | 422/100 |

* cited by examiner

*Primary Examiner*—Kevin Shaver
*Assistant Examiner*—Frederick C Nicolas
(74) *Attorney, Agent, or Firm*—Albert O. Cota

(57) ABSTRACT

A pre-filled disposable pipette for pharmaceutical and cosmetic products which has a hollow, round pipette body (40). The body consists of a hollow, rigid bulb section (44) forming a reservoir for storage and dispersion of the liquid pharmaceutical or cosmetic product which is pre-filled within the body. The body (40) further includes a hollow tubular section (46) that is smaller in diameter and contiguous with the bulb section, for ease of handling the pipette. The preferred embodiment has a hollow, frangible upper tube (42) with a distal end that is sealed for introducing air into the body (40) when the seal is broken, thus releasing the liquid from the tubular section. The liquid is dispensed from the body by breaking the upper tube allowing air to enter the pipette with the liquid flowing by gravity. The second embodiment has a resilient bulb section and omits the upper tube. A tapered section (90) is added to the tubular section, with a hollow tip (86) on the end. The liquid is dispensed from the body (40) by squeezing the bulb. A seal is in contact with the hollow tubular section, or tip, for retaining the liquid within the body and storage, consisting of either a liquid seal (58) or a resilient cap (50).

18 Claims, 4 Drawing Sheets

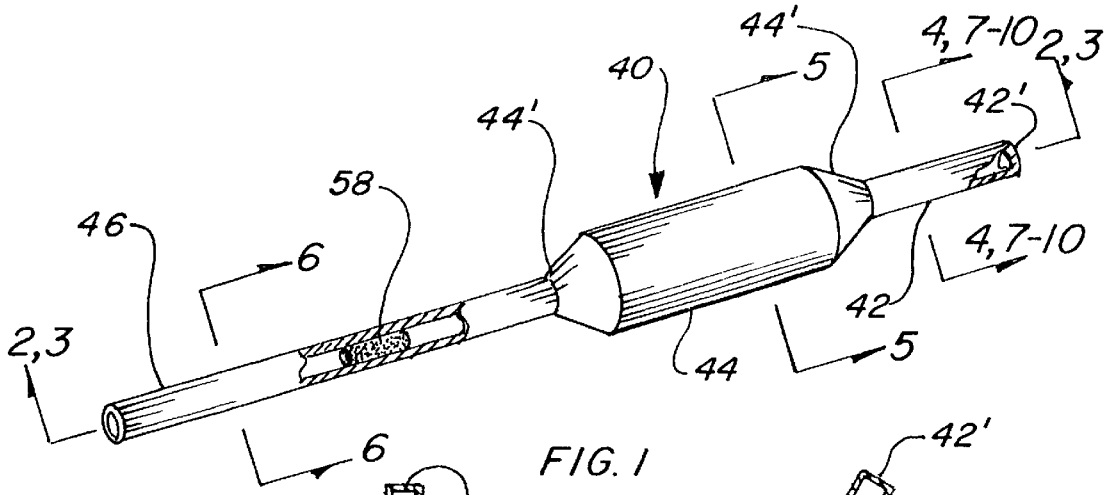
FIG. 1
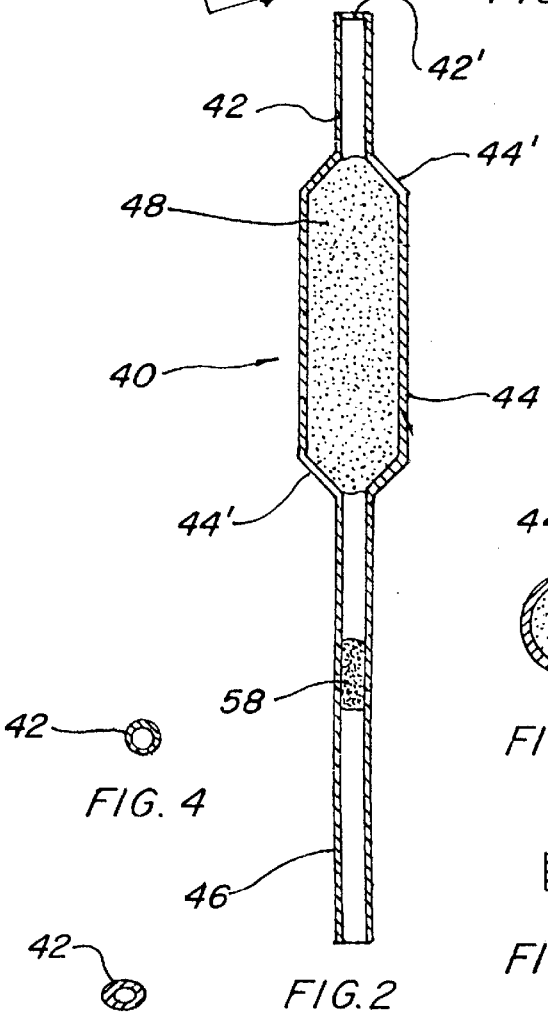
FIG. 2
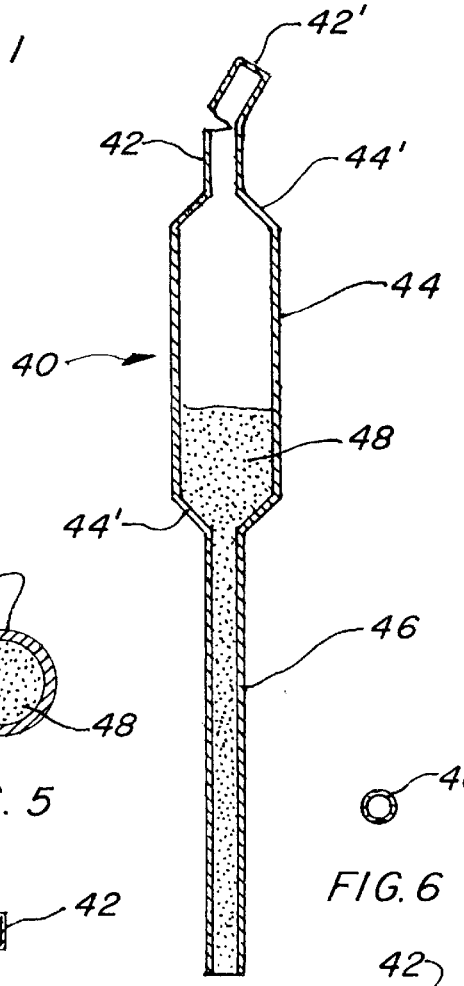
FIG. 3
FIG. 4
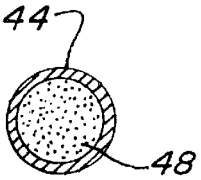
FIG. 5
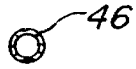
FIG. 6
FIG. 7
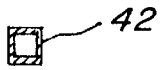
FIG. 8
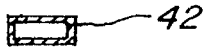
FIG. 9
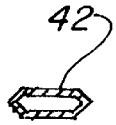
FIG. 10

PRE-FILLED DISPOSABLE PIPETTES

TECHNICAL FIELD

The invention generally pertains to pipettes, and more specifically, to a pipette made of a rigid or resilient material that is pre-filled with a pharmaceutical or cosmetic product and is used once and then discarded.

BACKGROUND ART

A typical pipette consists of a slender pipe or tube that is used to transfer or measure small quantities of a liquid or a gas from one location to another. The most common type of pipette consists of a small glass tube that widens into a bulb at the middle. Liquid may be sucked into the bulb and retained therein by closing the top end of the pipette with a stopper, thumb or the like. Since it is necessary to fill the pipette with the liquid, it would be beneficial to both medical practitioners and laboratory technicians to provide a disposable, one use pipette that is pre-filled with the required liquid. The pre-filled pipette would make the dispensing of the liquid much easier and faster, in that the step of filling the pipette is no longer needed, and the dispensing could be accomplished in a variety of ways that are already known in the art.

A search of the prior art did not disclose any patents that possess the novelty of the instant invention, however the following U.S. patents are considered related:

| U.S. Pat. No. | Inventor | Issue Date |
|---|---|---|
| 6,098,676 | Poynter et al. | Aug. 8, 2000 |
| 5,928,662 | Phillips | Jul. 27, 1999 |
| 5,799,837 | Firestone, et al. | Sep. 1, 1998 |
| 5,624,057 | Lifshey | Apr. 29, 1997 |
| 5,609,273 | Firestone, et al. | Mar. 11, 1997 |
| 5,578,020 | Mosley | Nov. 26, 1996 |
| 4,150,744 | Fennimore | Apr. 24, 1979 |
| 4,114,659 | Goldberg et al. | Sep. 19, 1978 |

Phillips in U.S. Pat. No. 6,098,676 teaches a drug delivery device that has a reservoir holding medicine for delivery to a patient. The device has a conduit with one end coupled to the reservoir and a free end to position within the fornix of a patients eye. Through gravity and capillary action the medicine flows into the eye with the rate of delivery adjusted according to the size and material of the conduit. The reservoir is made of an absorbent material provided with an impermeable backing which acts as a barrier, and in the preferred embodiment the backing has an adhesive for attaching to the eye of the patient.

U.S. Pat. No. 5,799,837 issued to Firestone, et al. is for a packaged pharmaceutical product having an extended shelf life and includes a container consisting of a hollow body with an open end. The body wall thickness enables drop-by drop dispensing of the medicine by manually squeezing the container body. A tip is fixed to the body to form droplets for application.

Lifshey in U.S. Pat. No. 5,624,057 discloses an ophthalmic storage and dispensing device formed by injection molding, consisting of a vial with thick rigid walls and a limited flexible area. The flexible area allows only a small displacement when squeezed, thus providing, a metered volume of liquid. The tip having a integral molded puncture membrane provides sealing.

Firestone, et al. in U.S. Pat. No. 5,609,273 teaches a barrier package that includes a container with a hollow body and an open end. The container has a body thickness that enables drop-by drop dispensing by manually squeezing the body. A dropper tip is fixed to the open end and forms droplets upon manual squeezing of the body.

U.S. Pat. No. 5,578,020 issued to Mosley is for an eye drop dispenser and dispensing sleeve. The dropper has a liquid reservoir portion and a dispensing end with a dropper orifice. Part of the reservoir is resilient, and a dispensing sleeve circumscribes the dropper tube with a pair of legs that extend beyond the end of the tube. The legs are adapted to fit against the orbital areas of an eye to support the dropper over the eye for application of the liquid.

Fennimore in U.S. Pat. No. 4,150,744 discloses a packaging device for light and oxygen sensitive liquid which includes a dropper spout. The vessel itself is sealed within a gas impermeable envelope under vacuum.

For background purposes and as indicative of the art to which the invention is related reference may be made to the remaining cited patents issued to Poynter, et al. in U.S. Pat. No. 6,098,676 and Goldberg, et al. in U.S. Pat. No. 4,114,659.

DISCLOSURE OF THE INVENTION

Pipettes and eye droppers, as well as containers in the form of bottles, tubes, vials etc., have been in use for over a century to hold, transfer and measure liquid products and are therefore accepted. Disposable single-use containers have been increasingly popular in recent years, particularly in the field of medicine and cosmetics. Therefore, the primary object of the invention is to provide a pre-filled pipette that is made of a thermoplastic material of a thickness permitting a bulb section to be squeezed to dispense the pre-filled liquid, or is made of a rigid plastic material to dispense the pre-filled liquid by breaking an upper tube end, either tearing or cutting, to release the liquid from within the pipette through the force of gravity once air is introduced above the product.

An important object of the invention is that the fabrication techniques used to produce the pipette are inexpensive enough to allow the pipette to be thrown away after use. Namely, this invention provides single use delivery and constantly furnishes fresh, uncontaminated products to consumers.

Another object of the invention is that the design of the pipette is ideal for the pharmaceutical and cosmetic industry as the material is compatible and the size and configuration of a relatively long cylindrical shape lends itself to this field of endeavor.

Yet another object of the invention is that a suitable applicator is part of the prefilled pipette. This applicator provides the user with a convenient built in holder. Thus, the user does not have to find and attach a separate applicator to the pipette as the tubular section serves as a suitable holder by itself. The applicator can also be labeled and protected to maintain cleanliness.

Still another object of the invention is that the liquid in the bulb of the pre-filled pipette is protected from bacteria or bioburden contamination by the liquid barriers located in the thin hollow tubular section.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 1 is a partial isometric view of the preferred embodiment.

FIG. 2 is a cross sectional view taken along lines 2—2 of FIG. 1 with the pipette in the filled condition with a liquid seal in place.

FIG. 3 is a cross sectional view taken along lines 3—3 of FIG. 1 with the upper tube severed with the liquid partially removed and the liquid seal previously dissipated.

FIG. 4 is a cross sectional view taken along lines 4—4 of FIG. 1 with the upper tube shown in the round configuration.

FIG. 5 is a cross sectional view taken along lines 5—5 of FIG. 1 illustrating the bulb section.

FIG. 6 is a cross sectional view taken along lines 6—6 of FIG. 1 illustrating the tubular section.

FIG. 7 is a cross sectional view taken along lines 7—7 of FIG. 1 with the upper tube shown in the oval configuration.

FIG. 8 is a cross sectional view taken along lines 8—8 of FIG. 1 with the upper tube shown in the square configuration.

FIG. 9 is a cross sectional view taken along lines 9—9 of FIG. 1 with the upper tube shown in the rectangular configuration.

FIG. 10 is a cross sectional view taken along lines 10—10 of FIG. 1 with the upper tube shown in a polygonal configuration.

BEST MODE FOR CARRYING OUT THE INVENTION

Figure 11:
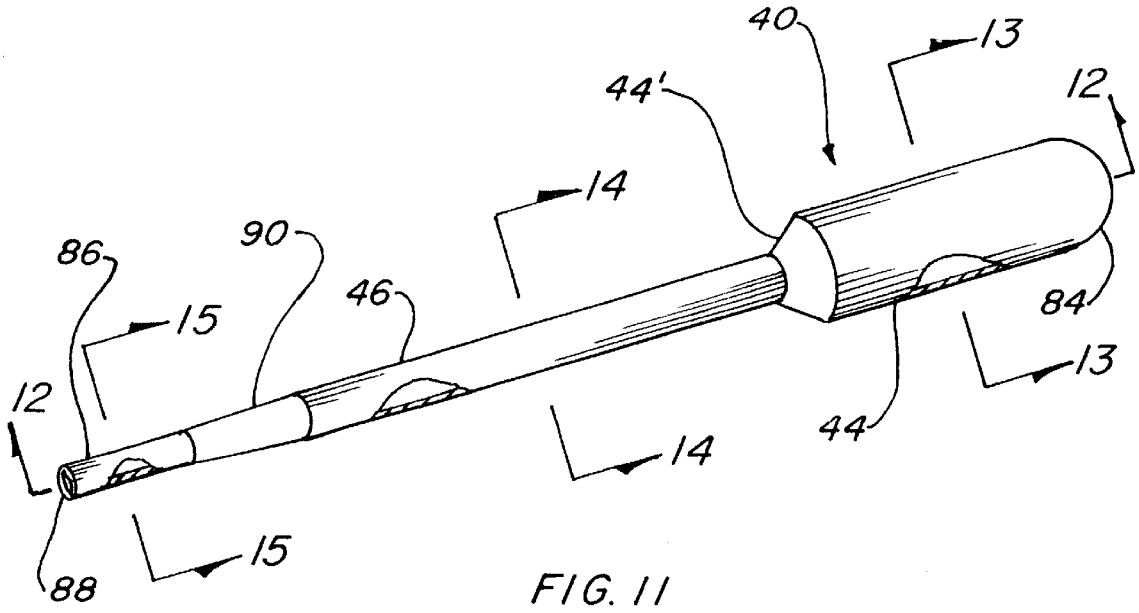
FIG. 11 is a partial isometric view of the second embodiment with no liquid inside the pipette.

The best mode for carrying out the invention is presented in terms of a preferred and a second embodiment. The preferred embodiment is shown in FIGS. 1 thorough 10 also 16 through 35 and is comprised of a hollow resilient round pipette body 40 constructed of a thermoplastic material such as polycarbonate, polyethylene, polyester, polystyrene, polypropylene, polysulfone, polyurethane, ethylene-vinyl-acetate or the like. The material may be transparent, translucent or opaque, according to the type of liquid product stored inside. The body 40 consists of three basic parts, a hollow frangible upper tube 42; a hollow resilient bulb section 44; contiguous with the frangible upper tube; and an open ended hollow tubular section 46, smaller in diameter also contiguous with the bulb section 44.

The frangible upper tube 42, which has a distal end 42' that is closed and sealed, functions by introducing air into the body when the seal is violated, as shown in FIG. 3. The frangible upper tube 42 is configured in such a manner as to be ruptured easily. This rupture may be achieved by having a thin radial section positioned conveniently for manual breaking, a longitudinal seam that is slender enough to split when squeezed together, or any other suitable method of breakage.

The upper tube 42 is configured in cross section, as shown in FIGS. 6–10, and consists of a round, oval, square, rectangular or polygonal shape preferably selected to maintain headspace using liquid surface tension and, capillary effect. The shapes that have a flat surface on at least one side, are preferred to facilitate the placement of a label when the pipette is used to contain pharmaceutical products.

The hollow, bulb section 44 is contiguous with the frangible upper tube 42 with the purpose of forming a reservoir for liquid storage and to augment dispensing of the liquid 48 inside the pipette. The bulb section 44 is in a cylindrical configuration with each end having a cone-shaped taper 44' that interfaces on one end with the frangible upper tube 42, and on the other end with the hollow tubular section 46.

The body 40 open ended hollow tubular section 46 is smaller in diameter and contiguous with the bulb section 44 for ease of handling the pipette and content distribution from within.

The pipette body 40 is pre-filled with the liquid 48, which consists of a pharmaceutical or cosmetic substance. The liquid 48 may be comprised of an aqueous solution, a true solution, oil, solvent, emulsion, cream, ointment, lotion, suspension, paste, jelly, syrup, balm or any other similar substance that may be transported and/or stored in a container.

Figure 20:
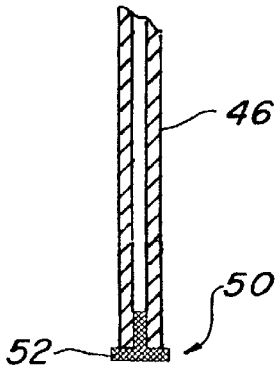
FIG. 20 is a cross sectional view taken on the centerline of both embodiments with a resilient cap applied to the end of the hollow tubular section in the inner plug configuration.
Figure 22:
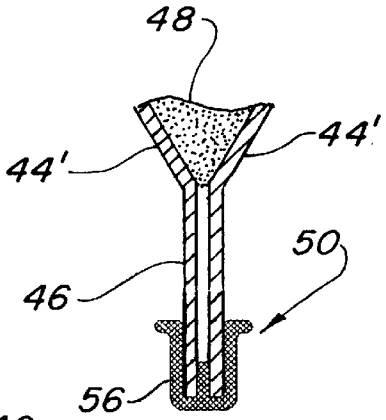
FIG. 22 is a cross sectional view taken on the centerline of both embodiments with the resilient cap applied to the end of the hollow tubular section in the combination inner and outer plug configuration.
Figure 21:
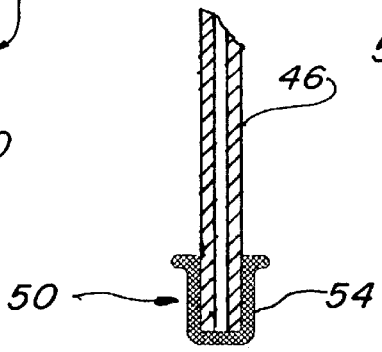
FIG. 21 is a cross sectional view taken on the centerline of both embodiments with the resilient cap applied to the end of the hollow tubular section in the outer plug configuration.
Figure 23:
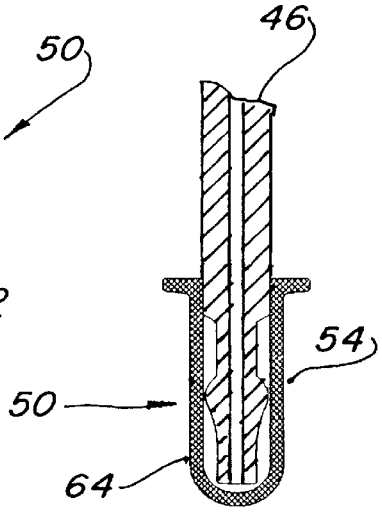
FIG. 23 is a cross sectional view taken on the centerline of both embodiments with the resilient cap applied to the end of the hollow tubular section in the outer plug configuration over a Uro-Jet distal tip applicator.
Figure 24:
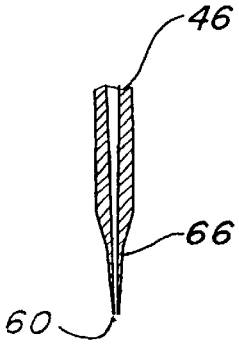
FIG. 24 is a cross sectional view taken on the centerline of both embodiments with the applicator tip configured as a needleless tip.
Figure 25:
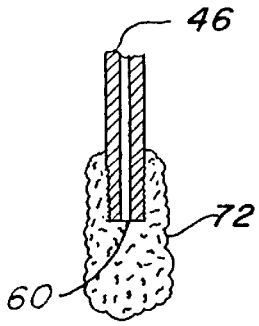
FIG. 25 is a cross sectional view taken on the centerline of both embodiments with the applicator tip configured as an absorbent cotton tip.
Figure 26:
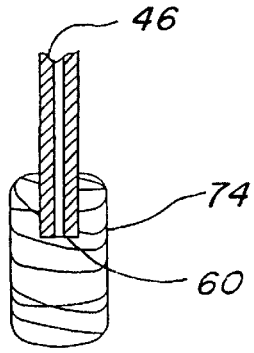
FIG. 26 is a cross sectional view taken on the centerline of both embodiments with the applicator tip configured as an absorbent band tip.
Figure 27:
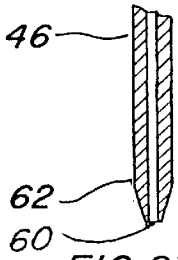
FIG. 27 is a cross sectional view taken on the centerline of both embodiments with the applicator tip configured as an eye dropper tip.
Figure 28:
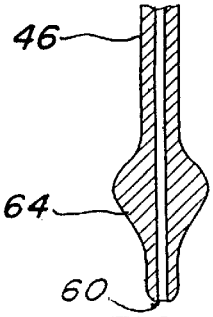
FIG. 28 is a cross sectional view taken on the centerline of both embodiments with the applicator tip configured as an Uro-Jet tip.
Figure 29:
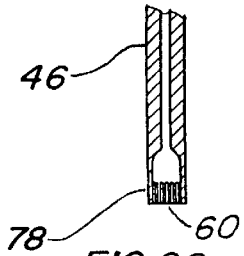
FIG. 29 is a cross sectional view taken on the centerline of both embodiments with the applicator tip configured as a multi-hole distributor tip.
Figure 30:
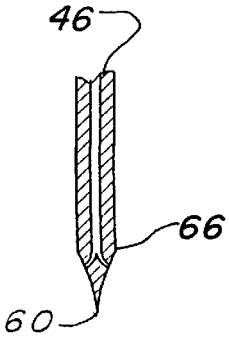
FIG. 30 is a cross sectional view taken on the centerline of both embodiments with the applicator tip configured also as a second type of needleless tip.
Figure 31:
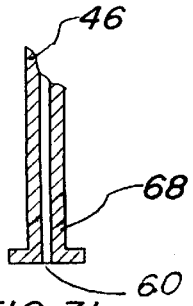
FIG. 31 is a cross sectional view taken on the centerline both embodiments with the applicator tip configured as a male Luer-Lock tip.
Figure 32:
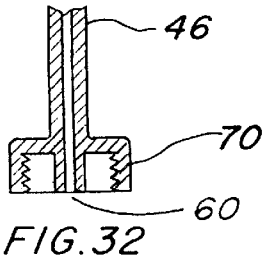
FIG. 32 is a cross sectional view taken on the centerline of both embodiments with the applicator tip configured as a female Luer-Lock tip.
Figure 33:
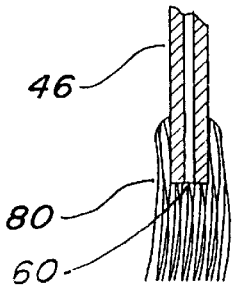
FIG. 33 is a cross sectional view taken on the centerline of both embodiments with the applicator tip configured as a brush tip.
Figure 34:
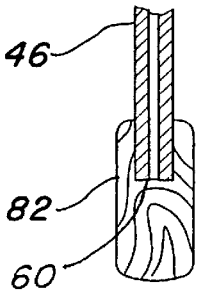
FIG. 34 is a cross sectional view taken on the centerline of both embodiments with the applicator tip configured as a cork tip.
Figure 35:
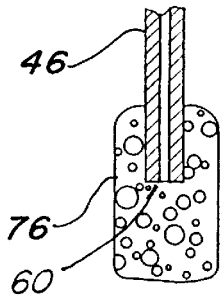
FIG. 35 is a cross sectional view taken on the centerline of both embodiments with the applicator tip configured as an absorbent foam tip.

Sealing means in contact with the distal end of the hollow tubular section 46 retains the liquid product 48 within the body 40 for storage, thus permitting the liquid product 48 to be dispersed from inside the pipette when the e upper tube 42 is cut or broken. This action permits air to enter the body 40, thereby allowing gravity to drain the product 48 from inside the pipette. The scaling means may be in the form of a resilient cap 50 that is configured to plug the open end of the hollow tubular section 46. Many and varied forms of the cap 50 may be used, such as an inner plug configuration 52, as shown in FIG. 20, an outer plug configuration 54, as shown in FIG. 21, a Uro-Jet distal tip applicator, as shown in FIG. 23, or a combination configuration 56, as shown in FIG. 22. The resilient cap 50 is preferably made of a thermoplastic material, however, synthetic rubber or other substances may be utilized according to the compatibility requirements of the liquid 48.

Figure 16:
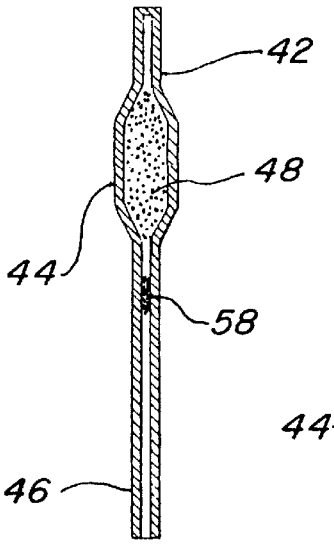
FIG. 16 is a cross sectional view taken on the centerline of the preferred embodiment filled with liquid and a liquid barrier in place at an ambient temperature of 0 degrees Centigrade.
Figure 17:
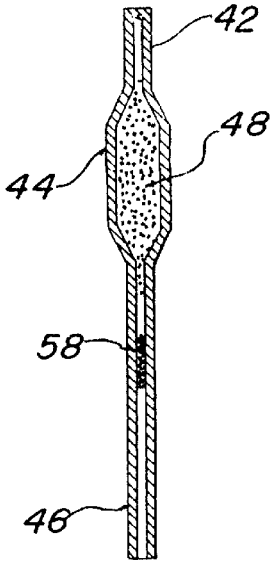
FIG. 17 is a cross sectional view taken on the centerline of the preferred embodiment filled with liquid and a liquid barrier in place at an ambient temperature of 20 degrees Centigrade.
Figure 18:
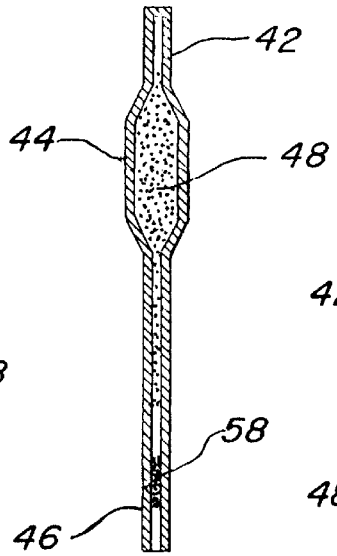
FIG. 18 is a cross sectional view taken on the centerline of the preferred embodiment filled with liquid and a liquid barrier in place at an ambient temperature of 40 degrees Centigrade.
Figure 19:
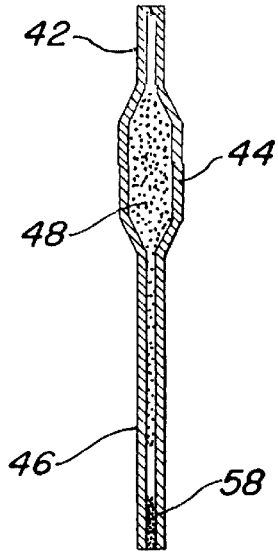
FIG. 19 is a cross sectional view taken on the centerline of the preferred embodiment filled with liquid and a liquid barrier in place at an ambient temperature of 50 degrees Centigrade.

Another embodiment of the sealing means is in the form of a liquid barrier 58, which may consist of oil, jelly or cream with each including the addition of a preservative reagent or a bacterial retardant. It should be noted that the liquid barrier 58 is not solid, and as such is free to move within the tubular section 46 of the pipette as the volume of the liquid 48 changes with the ambient temperature. As an example, FIG. 16 illustrates the barrier position with a typical liquid at 0 degrees Centigrade, FIG. 17 depicts the same product 20 degrees Centigrade, FIG. 18 shows the difference at 40 degrees Centigrade and FIG. 19 concludes the illustrations with the corresponding liquid 48 at a temperature of 50 degrees Centigrade. Note that the internal diameter of the hollow tubular section 46 should be carefully selected to maintain the liquid barrier 58. A typical range of the internal diameter is 0.5–2.5 mm.

The pipette consists of a hollow tubular section 46 which includes an applicator tip 60 at its open end with a multitude of types available that would function equally well. Some of the type s of tips are illustrated in FIGS. 24–35, and include the following with their corresponding figure(s): an eye dropper tip 62, FIG. 27; a Uro-Jet tip 64, FIG. 28; a needleless tip 66, FIGS. 24 and 30; a male Luer-Lock tip 68, FIG. 31; a female Luer-Lock tip 70, FIG. 32; an absorbent cotton tip 72, FIG. 25, an absorbent band tip 74, FIG. 26; an absorbent foam tip 76, FIG. 35; a multi-hole distributor 78, FIG. 29, a brush tip 80, FIG. 33, and a cork tip 82, FIG. 34.

Figure 12:
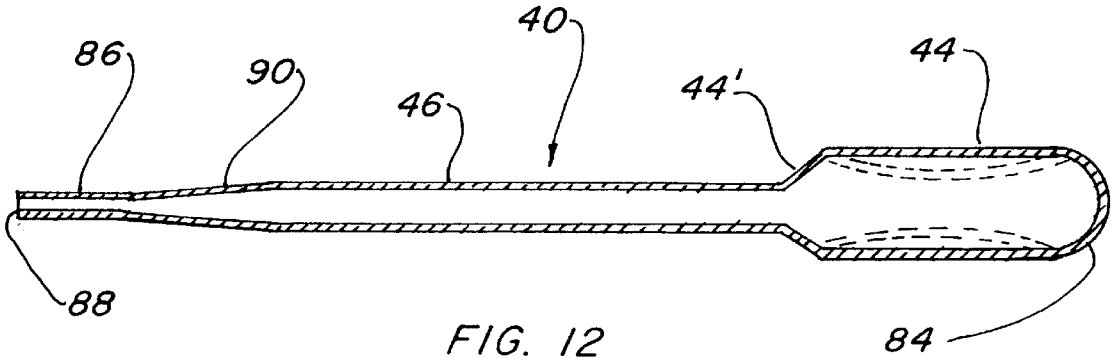
FIG. 12 is a cross sectional view taken along lines 12—12 of FIG. 11 with the resilient bulb section shown squeezed in the middle with dotted lines.
Figure 13:
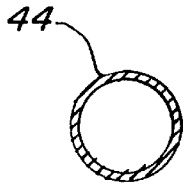
FIG. 13 is a cross sectional view taken along lines 13—13 of FIG. 11.
Figure 14:
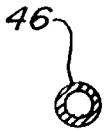
FIG. 14 is a cross sectional view taken along lines 14—14 of FIG. 11.
Figure 15:
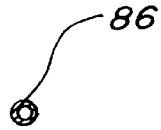
FIG. 15 is a cross sectional view taken along lines 15—15 of FIG. 11.

The second embodiment of the invention is illustrated in FIGS. 11–15 and 20–35, and is basically the same as the preferred embodiment except the upper tube 42 is omitted and the configuration of the bulb section 44 is resilient and simply replaces the cone-shaped taper 44' on the upper end with a hemispherical closure 84, as illustrated in FIGS. 11 and 12. The tubular section 46 also differs slightly in that the body 40 also has a hollow tip section 86, with an open end 88 adjoining the tubular section 46 for controlled distribution of contents from within the pipette. A tapered section 90 is disposed between the hollow tubular section 46 and the hollow tip section 86, as the hollow tip section 86 is considerably smaller, having an internal diameter from at least two to three times smaller than the internal diameter of the hollow tubular section 46. The tapered section 90 also allows a smooth and even transition between the two tubular elements. It should also be noted that the body hollow tubular section 46 has a length that is at least two times longer than the body hollow tip section 86. The balance of the elements are the same as the preferred embodiment and the operation is similar, except the bulb section 44 completely controls the distribution of the pre-filled contents of the pipette.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

What is claimed is:

1. A pre-filled disposable pipette for pharmaceutical and cosmetic products comprising:

a) a hollow round pipette body, b) said body having a hollow bulb section forming a reservoir for storage, c) said body further having a open ended hollow tubular section smaller in diameter and contiguous with the bulb section, for ease of handling the pipette, and content distribution from within the pipette, d) a liquid consisting of pharmaceutical or cosmetic substances disposed within the pipette body, and e) sealing means in contact with the tubular section for retaining the liquid within the body for storage, and when removed, permitting the liquid to be dispersed from the hollow tubular section of the pipette body wherein said pipette sealing means further comprises a liquid barrier selected from a group consisting of oil, jelly and cream each including a preservative reagent or a bacterial retardant.

2. A pre-filled disposable pipette for pharmaceutical and cosmetic products comprising:

a) a hollow round pipette body, b) said body having a hollow frangible upper tube with a distal end sealed for introducing air into the body when the seal is violated, c) said body further having a hollow resilient bulb section contiguous with the frangible upper tube, said bulb section forming a reservoir for storage, d) said body also having a open ended hollow tubular section smaller in diameter and contiguous with the bulb section for ease of handling the pipette and content distribution from within the pipette, e) a liquid consisting of pharmaceutical or cosmetic substances disposed within the pipette body, and f) sealing means in contact with the hollow, tubular section for retaining the liquid product within the body for storage, permitting the liquid to be dispersed from inside the pipette body when the upper tube is cut or torn, thereby permitting air to enter the body, which allows gravity to drain the liquid from inside the pipette wherein said pipette sealing means further comprises a liquid barrier selected from a group consisting of oil, jelly and cream each including a preservative reagent or a bacterial retardant.

3. The pre-filled disposable pipette as recited in claims 1 or 2 wherein said pipette is constructed of a thermoplastic material selected from a group consisting of: polycarbonate, polyethylene, polyester, polystyrene, polypropylene, polysulfone, polyurethane, or ethylene-vinyl-acetate.

4. The pre-filled disposable pipette as recited in claims 1 or 2 wherein said pipette's hollow, frangible upper tube is configured is such a manner as to be ruptured easily.

5. The pre-filled disposable pipette as recited in claims 1 or 2 wherein said pipette's hollow, frangible upper tube is configured in cross section as selected from a group consisting of round, oval, square, rectangular and polygonal shapes.

6. The pre-filled disposable pipette as recited in claims 1 or 2 wherein said pipette's bulb section has a cylindrical configuration with each end having a cone-shaped taper interfacing on one end with the frangible upper tube, and on the other end with the hollow tubular section.

7. The pre-filled disposable pipette as recited in claims 1 or 2 wherein said liquid product is selected from a group consisting of aqueous solution, true solution, oil, solvent, emulsion, cream, ointment, lotion, suspension, paste, jelly, syrup or balm.

8. The pre-filled disposable pipette as recited in claims 1 or 2 wherein said pipette sealing means further comprises a resilient cap configured to plug the hollow tubular section open end.

9. The pre-filled disposable pipette as recited in claims 1 or 2 wherein said pipette's hollow, tubular section further comprises an applicator tip at its open end selected from a group consisting of an eye dropper tip, a Uro-Jet tip, a needleless tip, a male Luer-Lock tip, a female Luer-Lock tip, an absorbent cotton tip, an absorbent band tip, an absorbent foam tip, a multi-hole distributor, a brush tip or a cork tip.

10. A pre-filled disposable pipette for pharmaceutical and cosmetic products comprising:

a) a hollow resilient pipette body, b) said body having a hollow bulb section forming a reservoir for storage and dispersion, c) said body further having a hollow tubular section smaller in diameter and contiguous with the bulb section for ease of handling the pipette, d) said body also having a hollow tip section with an open end adjoining the tubular section for distribution of contents from within the pipette, e) a liquid pharmaceutical or cosmetic product disposed within the pipette body, and f) sealing means in contact with the hollow tip for retaining the liquid within the body for storage and when removed permitting the liquid to be dispersed from the pipette body wherein said pipette sealing means further comprises a liquid barrier selected from a group consisting of oil, jelly and cream each including a preservative reagent or a bacterial retardant.

11. The pre-filled disposable pipette as recited in claim 10 wherein said pipette is constructed of a thermoplastic material selected from a group consisting of polycarbonate, polyethylene, polyester, polystyrene, polypropylene, polysulfone, polyurethane, or ethylene-vinyl-acetate.

12. The pre-filled disposable pipette as recited in claim 10 wherein said pipette bulb section has a cylindrical configuration including a first end and a second end, with the first end having a cone-shaped taper interfacing with the hollow tubular section, and the second end forming a hemispherical closure.

13. The pre-filled disposable pipette as recited in claim 10 wherein said body hollow tubular has a length that is at least two times longer than the body hollow tip section.

14. The pre-filled disposable pipette as recited in claim 10 further comprising a tapered section between the hollow tubular section and the hollow tip section.

15. The pre-filled disposable pipette as recited in claim 10 wherein said hollow tip section has an internal diameter from at least two to three times smaller than the hollow tubular section's internal diameter.

16. The pre-filled disposable pipette as recited in claim 10 wherein said liquid product is selected from a group consisting of aqueous solution, true solution, oil, solvent, emulsion, cream, ointment, lotion, suspension, paste, jelly, syrup or balm.

17. The pre-filled disposable pipette as recited in claim 10 wherein said pipette hollow section further comprises an applicator tip at its open end selected from a group consisting of an eye dropper tip, a Uro-Jet tip, a needleless tip, a male Luer-Lock tip, a female Luer-Lock tip, an absorbent cotton tip, an absorbent band tip, an absorbent foam tip, an absorbent foam tip, an absorbent cloth tip, a multi-hole distributor, a brush tip or a cork tip.

18. The pre-filled disposable pipette as recited in claim 10 wherein said pipette sealing means further comprises a resilient cap configured to plug the hollow tubular section's open end.

* * * * *